US011384778B2

(12) United States Patent
Dany et al.

(10) Patent No.: US 11,384,778 B2
(45) Date of Patent: Jul. 12, 2022

(54) ELECTRO-HYDROSTATIC ACTUATOR SYSTEM

(71) Applicant: Moog Luxembourg S.a.r.l., Bettembourg (LU)

(72) Inventors: Sascha Dany, Detzem (DE); Reiner Kohlhaas, Osburg (DE); Kristof Schlemmer, Saarlouis (DE)

(73) Assignee: Moog Luxembourg S.a.r.l., Bettembourg (LU)

( * ) Notice: Subject to any disclaimer, the term of this patent is extended or adjusted under 35 U.S.C. 154(b) by 0 days.

(21) Appl. No.: 17/293,181

(22) PCT Filed: Oct. 17, 2019

(86) PCT No.: PCT/EP2019/078273

§ 371 (c)(1),
(2) Date: May 12, 2021

(87) PCT Pub. No.: WO2020/099060

PCT Pub. Date: May 22, 2020

(65) Prior Publication Data

US 2022/0003250 A1 Jan. 6, 2022

(30) Foreign Application Priority Data

Nov. 13, 2018 (DE) ..... 102018128318.0

(51) Int. Cl.
*F15B 11/16* (2006.01)
*F15B 1/02* (2006.01)
(Continued)

(52) U.S. Cl.
CPC ..... *F15B 11/16* (2013.01); *B21D 24/14* (2013.01); *F15B 1/021* (2013.01); *F15B 1/024* (2013.01);
(Continued)

(58) Field of Classification Search
CPC .. F15B 1/02; F15B 1/024; F15B 11/16; F15B 11/20; F15B 11/22
(Continued)

(56) References Cited

U.S. PATENT DOCUMENTS 6,647,719 B2 * 11/2003 Truninger ..... F15B 21/14 60/414
8,407,993 B2 * 4/2013 Vigholm ..... E02F 9/2095 60/327
(Continued)

FOREIGN PATENT DOCUMENTS

CN 2852100 Y 12/2006
DE 894384 C 12/1953
(Continued)

OTHER PUBLICATIONS

European Patent Office (ISA/EP), International Search Report and Written Opinion of the ISA from International Patent Application No. PCT/EP2019/078273, dated May 22, 2020.

*Primary Examiner* — Michael Leslie
(74) *Attorney, Agent, or Firm* — Harter Secrest & Emery LLP

(57) ABSTRACT

The electrohydrostatic actuator system according to the invention comprises a volume-variable and/or rotational-speed-variable hydro machine, which is driven by an electric motor, for providing a volume flow of a hydraulic fluid, and a main shaft which is movable by the hydraulic fluid and which has at least one first chamber, wherein the first chamber, with at least one first main hydraulic line and a first main valve, is hydraulically connected to the hydro machine via a connection line. The actuator system according to the invention further comprises a secondary shaft which is movable by the hydraulic fluid and which has at least one first chamber, wherein the first chamber, with at least one first secondary hydraulic line and a first secondary valve, is
(Continued)

Figure 1:
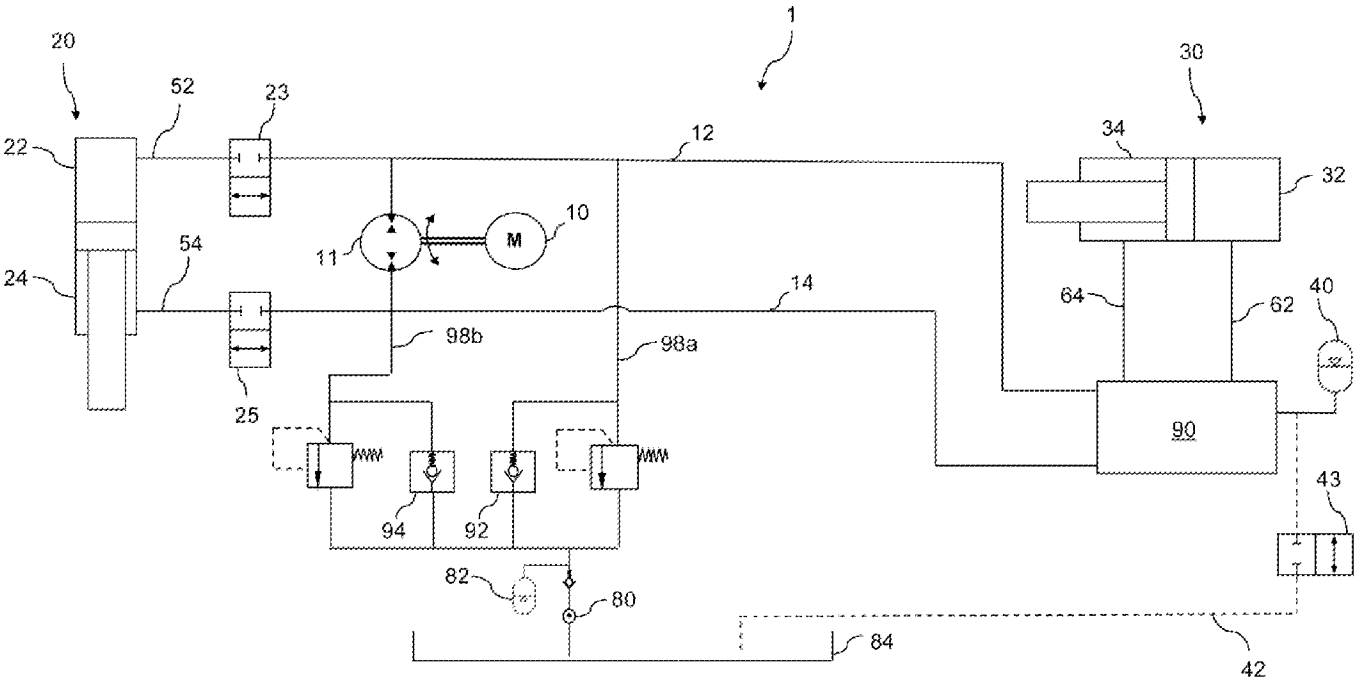

hydraulically connected to the hydro machine via a connection line. Furthermore, according to the invention, a hydraulic accumulator is hydraulically connected to the first secondary hydraulic line in the area between the first chamber of the secondary shaft and the first secondary valve.

18 Claims, 6 Drawing Sheets

(51) Int. Cl.
*F15B 11/20* (2006.01)
*B21D 24/14* (2006.01)
*F15B 11/22* (2006.01)

(52) U.S. Cl.
CPC ..... *F15B 11/20* (2013.01); *F15B 11/22* (2013.01); *F15B 2211/20515* (2013.01); *F15B 2211/20546* (2013.01); *F15B 2211/212* (2013.01); *F15B 2211/27* (2013.01); *F15B 2211/30505* (2013.01); *F15B 2211/30595* (2013.01); *F15B 2211/3138* (2013.01); *F15B 2211/31541* (2013.01); *F15B 2211/31552* (2013.01); *F15B 2211/613* (2013.01); *F15B 2211/625* (2013.01); *F15B 2211/7128* (2013.01)

(58) Field of Classification Search
USPC ..... 60/413, 414, 473, 474, 475, 476
See application file for complete search history.

(56) References Cited

U.S. PATENT DOCUMENTS

| | | | | |
|---|---|---|---|---|
| 8,596,058 | B2 * | 12/2013 | Matsumoto | G01N 3/10 60/468 |
| 11,110,505 | B2 * | 9/2021 | Kohno | B21D 24/02 |
| 2012/0048029 | A1 | 3/2012 | Matsumoto et al. | |
| 2017/0008061 | A1 | 1/2017 | Kohno | |
| 2019/0162208 | A1 | 5/2019 | Haendle et al. | |
| 2021/0332831 | A1 * | 10/2021 | Dany | F15B 7/006 |

FOREIGN PATENT DOCUMENTS

| | | | |
|---|---|---|---|
| EP | 0613740 | A1 | 9/1994 |
| EP | 2637852 | B1 | 1/2017 |

* cited by examiner

ELECTRO-HYDROSTATIC ACTUATOR SYSTEM

The present invention relates to an electrohydrostatic actuator system and in particular an electrohydrostatic actuator system having two movable shafts.

Electrohydrostatic actuator systems are widely known in the prior art, wherein usually only one consumer is operated by an actuator. If several consumers are used in the system, then several actuators are required in the prior art.

Once several consumers are simultaneously operated with one or more parallel pump units, the volume flow takes the path of least resistance and the consumers, e.g., the shafts, move in an undefined manner, resulting in an uncontrollable system.

Furthermore, for using several actuators, a constant pressure system may be provided. This constant pressure system is fed either continuously or non-continuously through a pump line, wherein if peak powers are required, they are output via an accumulator system. However, such a system consumes much energy and manifests sluggish control, therefore requiring improved actuator systems.

Based on this prior art, it is thus an object of the present invention to at least partially overcome or improve upon the disadvantages of the prior art.

The object is achieved with a device according to claim 1. Preferred embodiments and modifications are the subject matter of the subclaims. A method according to the invention for using the system according to the invention is specified in claims 15 and 16.

The electrohydrostatic actuator system according to the invention comprises a volume-variable and/or rotational-speed-variable hydro machine, which is driven by an electric motor, for providing a volume flow of a hydraulic fluid, and a main shaft which is movable by the hydraulic fluid and which has at least one first chamber, wherein the first chamber, with at least one first main hydraulic line and a first main valve, is hydraulically connected to the hydro machine via a connection line.

The actuator system according to the invention further comprises a secondary shaft which is movable by the hydraulic fluid and which has at least one first chamber, wherein the first chamber, with at least one first secondary hydraulic line and a first secondary valve, is hydraulically connected to the hydro machine via a connection line.

Furthermore, according to the invention, a hydraulic accumulator is hydraulically connected to the first secondary hydraulic line in the area between the first chamber of the secondary shaft and the first secondary valve.

According to the invention, an electrohydrostatic actuator system is accordingly provided which has a volume-variable or rotational-speed variable hydro machine which is driven by an electric motor and has a main shaft and a secondary shaft, each having at least one chamber. The at least one chamber of the main and secondary shafts is in each case hydraulically connected to a main or secondary hydraulic line and via a main or secondary valve to the hydro machine. A hydraulic accumulator, which is hydraulically connected to the secondary hydraulic line, is arranged between the chamber of the secondary shaft and the secondary valve.

Electric motors are known in the prior art and serve to drive the hydro machine.

The hydro machine is volume-variable and/or rotational-speed-variable and can preferably provide two possible flow directions of the hydraulic fluid in the closed hydraulic circuit during operation. The hydro machine may further comprise either an electric motor with variable rotational speed and a fixed displacement pump, or an electric motor with constant rotational speed and a variable displacement pump, or an electric motor with variable rotational speed and a variable displacement pump. The selection of the hydro machine is in this case determined by factors such as system costs, reliability, permitted noise emission or efficiency.

The shafts of the actuator system according to the invention are movable, wherein the movement is preferably provided by hydraulic fluid entering or exiting the chambers and the pressure buildup or pressure reduction associated therewith.

For example, in one embodiment according to the invention, the main shaft may be a reshaping shaft and the secondary shaft may be a clamping shaft. In this case, a workpiece to be machined is clamped by the clamping shaft and (re)shaped by the reshaping shaft. However, according to further embodiments, the shafts may also have further functions.

According to a further embodiment of the actuator system according to the invention, the main shaft and/or the secondary shaft is preloaded mechanically and in particular with a spring system and/or a weight system.

In this case, it is particularly advantageous to use the shafts for the same process flow and not for different functions which are not correlated with one another. Namely, if the functions are connected to one another, the present invention is particularly advantageous since a process requiring two shafts can be controlled by means of a single hydro machine, as explained in more detail later.

The terms "main shaft" and "secondary shaft" are not to be understood as meaning that one of the shafts is more important than the other but rather serve only to distinguish the shafts; in particular, both shafts can also perform an identical function, such as the clamping of a workpiece.

Both the main shaft and the secondary shaft have at least one first chamber into which hydraulic fluid can flow. The chambers are each hydraulically connected via a line and via a valve to a connection of the hydro machine. The hydro machine operated by the electric motor thus provides a hydraulic fluid flow into the respective first chambers of the main and secondary shafts, which causes a movement of the shafts to occur.

The arrangement of the hydraulic accumulator in the first secondary hydraulic line in the area between the first chamber of the secondary shaft and the first secondary valve is advantageous in this embodiment according to the invention. Through the arrangement of the hydraulic accumulator according to the invention, the hydraulic fluid in the hydraulic accumulator is also loaded by the loading of the hydraulic fluid of the secondary shaft so that the pressure of the hydraulic fluid in the first chamber of the secondary shaft corresponds to the pressure of the hydraulic fluid in the hydraulic accumulator.

It is thus possible, by closing the secondary valve, to maintain the pressure in the area of the first chamber of the secondary shaft and in the secondary hydraulic line by means of the hydraulic accumulator without requiring the hydro machine for pressure maintenance.

Accordingly, after the secondary shaft has been loaded, the hydro machine can be used for loading or for controlling the primary shaft. Thus, the primary shaft can be operated by means of the same hydro machine, wherein in particular both shafts can work in parallel by means of a single hydro machine.

The use of a single hydro machine for the parallel control of two shafts is advantageous since it leads both to savings in effort and savings in cost. Furthermore, a reduction of the required devices occurs, which in turn leads to a minimization of potential failures and/or damage.

In a further embodiment according to the invention, the hydraulic fluid is preloaded in the connection lines. The preloading may be provided, for example, by means of a further hydro machine, a pressure accumulator or the like.

In this case, the connection lines are the lines which hydraulically connect the main or secondary valve to the connections of the hydro machine. In this case, preloading the connection lines is advantageous since a certain pressure thus always prevails in the system; accordingly, hydraulic fluid does not have to be continuously loaded from a completely relieved state to the desired state, which in turn leads to substantial savings in energy. The pressure in the connection lines can be 10 bar, for example. The main reason for preloading is to ensure a minimum pressure in the two actuator chambers and thus to avoid cavitation even in the event of a great pressure drop, for example in the event of rapid pressure changes and movements.

Furthermore, in a further embodiment according to the invention, the first secondary hydraulic line can be hydraulically connected to a drain line and a safety valve and/or a 2-way valve, in particular a drain valve.

The pressure in the secondary hydraulic line, and accordingly the pressure of the first chamber of the secondary shaft and the pressure of the hydraulic accumulator, can be relieved by the drain line.

Such a drainage system can correspondingly also be used and arranged in the main hydraulic line. Accordingly, the drain lines of the main hydraulic line and of the secondary hydraulic line may also be the same. Within the meaning of the invention, it is also the case that the hydraulic fluid relieved in the drain line flows into a tank where it can be used for further purposes. In this case, the tank can be the same tank which serves for feeding hydraulic fluid into the system, whereby a closed system is provided. Furthermore, cleaning, venting and/or cooling devices can also be connected to the drain line so that, for example, the hydraulic fluid is vented before it is fed back into the system.

The connection line can also be arranged in such a way that it serves only for relieving the hydraulic accumulator, while the first chamber of the secondary shaft is relieved by means of a further line, for example by means of the connection line, which is also connected to the tank. It is thus possible to precisely control where the pressure is to be relieved.

It is also within the meaning of the invention that the hydro machine can be used for relieving the chambers of the main and/or secondary shaft. For example, the hydro machine may provide a hydraulic fluid flow from one of the chambers into the tank by displacement.

In a further embodiment according to the invention, the first chamber of the main shaft and the first chamber of the secondary shaft are hydraulically connected to the same connection line of the hydro machine.

The further connection line of the hydro machine can, for example, be hydraulically connected to the tank from which the hydraulic fluid for loading the actuator system is taken.

Only by adjusting the main or secondary valve is it thus possible to set the chamber in which a hydraulic fluid flow is provided by the hydro machine. For this purpose, it is advantageous and a further embodiment according to the invention that the first main valve and/or the first secondary valve are controlled valves. In particular, it is advantageous if both valves are controllable since improved and more accurate actuator control is thus made possible and the process sequences can thus be controlled more easily. The secondary valve can also be a continuous valve in further embodiments according to the invention so that a local constant pressure system is produced by the hydraulic accumulator and the valve.

Controlling can occur in any way known in the prior art, such as by means of electrically controlled valves.

In a further embodiment according to the invention, the main shaft has at least one second chamber, wherein the second chamber, with at least one second main hydraulic line and a second main valve, is hydraulically connected to the hydro machine via a connection line.

In a further embodiment of the actuator system according to the invention, the secondary shaft also has at least one second chamber, wherein the second chamber, with at least one second secondary hydraulic line and a second secondary valve, is hydraulically connected to the hydro machine via a connection line.

In the embodiments in which the shafts have at least two chambers, the main shaft and the secondary shaft may be selected from a group including, for example, differential cylinders, common-mode cylinders, telescoping cylinders, and similar cylinders. The choice of shaft type is dependent on the function the shafts must perform; for example, the main shaft may be a differential cylinder if the shaft is used in a press. The main shaft and the secondary shaft do not necessarily have to be designed as the same type of cylinder.

If both the main shaft and the secondary shaft each have a second chamber, then, in a further embodiment according to the invention, the second chamber of the main shaft and the second chamber of the secondary shaft are hydraulically connected to the same connection line of the hydro machine, wherein the connection line is different from the connection line to which the first chamber of the main and secondary shafts is hydraulically connected.

It is advantageous if the respective second chambers of the shafts are connected to the same line since fewer lines are thus used and the system can be operated in a simplified manner.

In a further embodiment according to the invention, the second main valve and/or the second secondary valve are controlled valves.

As already is the case with the first main valve and the first secondary valve, the controllability of the second main and/or secondary valves offers improved control of the entire system, whereby the efficiency of the system can be improved and can thus be operated in a more energy-saving and cost-saving manner.

In a further embodiment of the actuator system according to the invention, at least one of the controlled valves can be released by means of a control valve.

In a further embodiment of the actuator system according to the invention, at least one of the control valves is hydraulically connected to at least one of the connection lines of the hydro machine by means of non-return valves.

This means that the circuits of the control valves for the main and/or secondary valves are hydraulically connected to the connection lines of the hydro machine. Thus, hydraulic fluid which is in the system also flows through the circuits of the control valves, as a result of which no additional loading and in particular no additional independent control circuit is required.

A method for operating the electrohydrostatic actuator system according to the invention according to one of the described embodiments is also claimed. In such a method according to the invention, the main shaft and the secondary shaft are operated in parallel or sequentially by the same hydro machine.

This is an advantageous method compared to the methods known from the prior art since in particular the parallel operation of the shafts by means of a single hydro machine brings about several already mentioned advantages.

The parallel operation of the shafts generally consists of several steps. First, the secondary shaft is loaded by means of the hydro machine, wherein the hydraulic accumulator or the hydraulic fluid in the hydraulic accumulator is also loaded by the loading of the first chamber of the secondary shaft.

At a sufficient pressure in the first chamber of the secondary shaft, the connection to the hydro machine is interrupted by means of the secondary valve. Since the loaded hydraulic accumulator is connected to the chamber of the secondary shaft, the secondary shaft remains loaded. Accordingly, the hydro machine is used to provide a hydraulic fluid flow into the primary shaft. After the process, the shafts are relieved.

Not least, the use of an actuator system according to the invention by means of one of the methods described above is also claimed. In this case, the system can be used for reshaping molded parts, for deep-drawing molded parts, or by other similar methods in which an electrohydrostatic actuator system is required.

The invention is explained below on the basis of various exemplary embodiments, wherein it is pointed out that these examples encompass modifications or additions as they immediately arise for the person skilled in the art.

Figure 2:
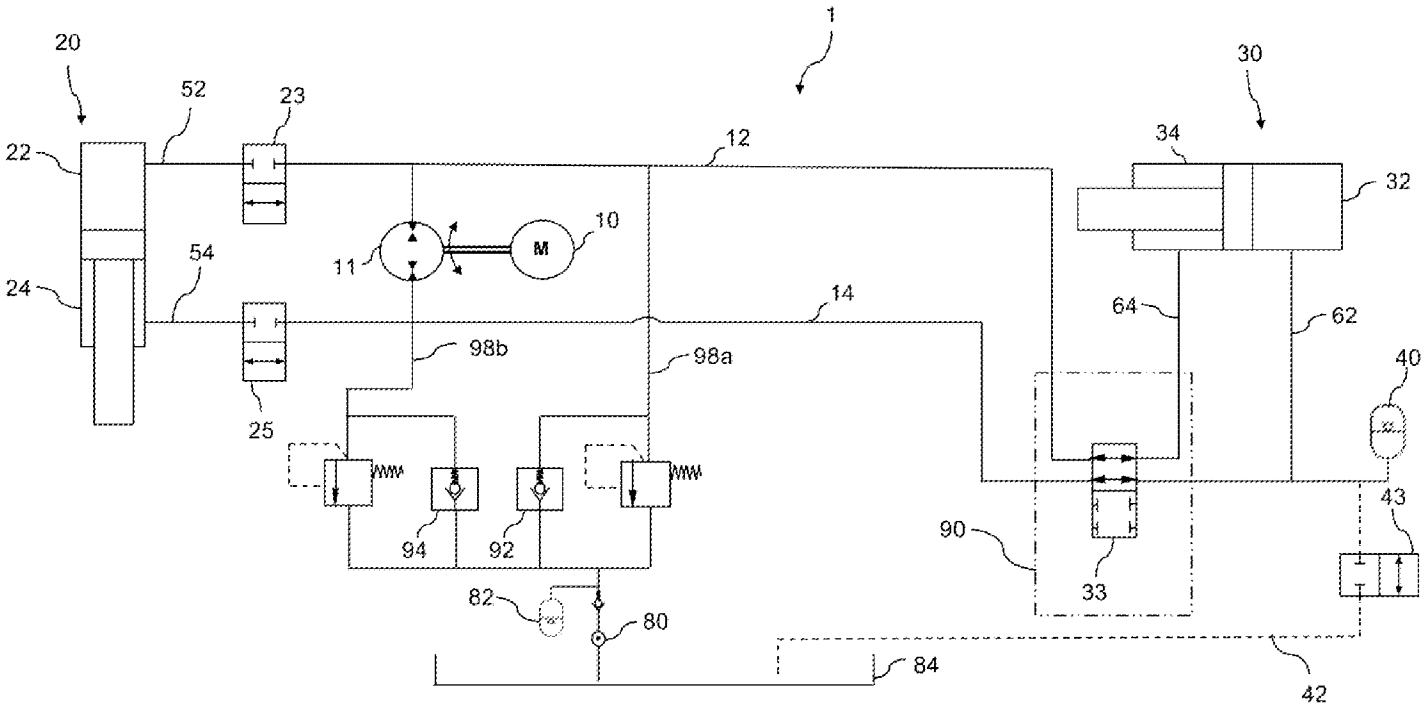
Figure 3:
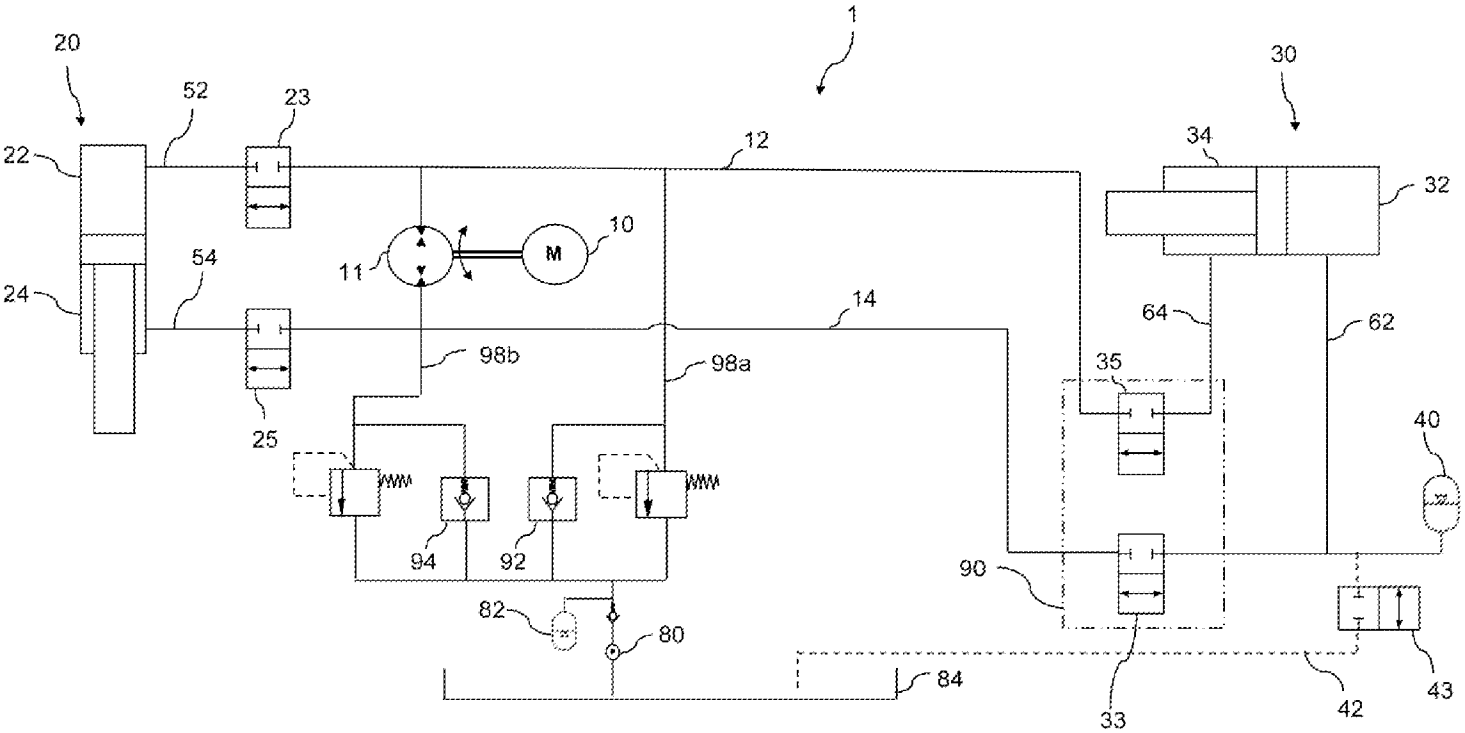
Figure 4:
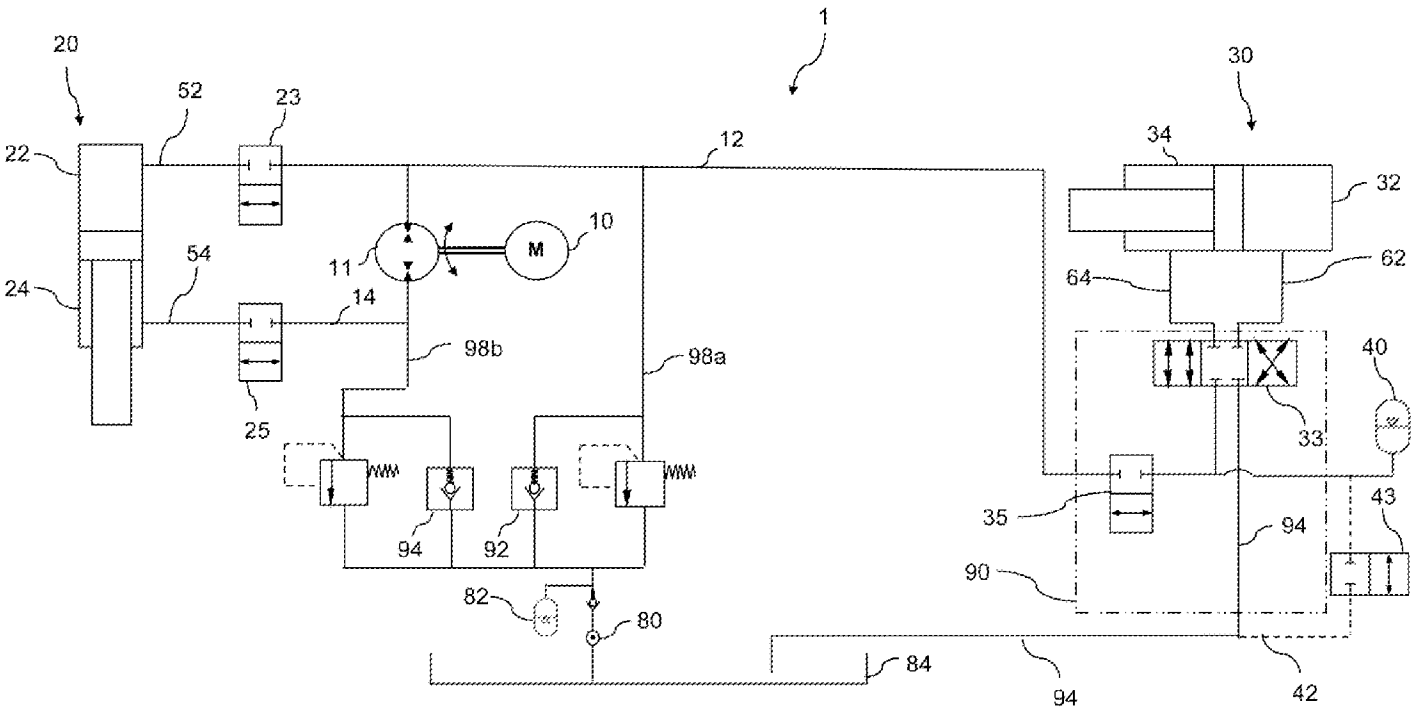
Figure 5:
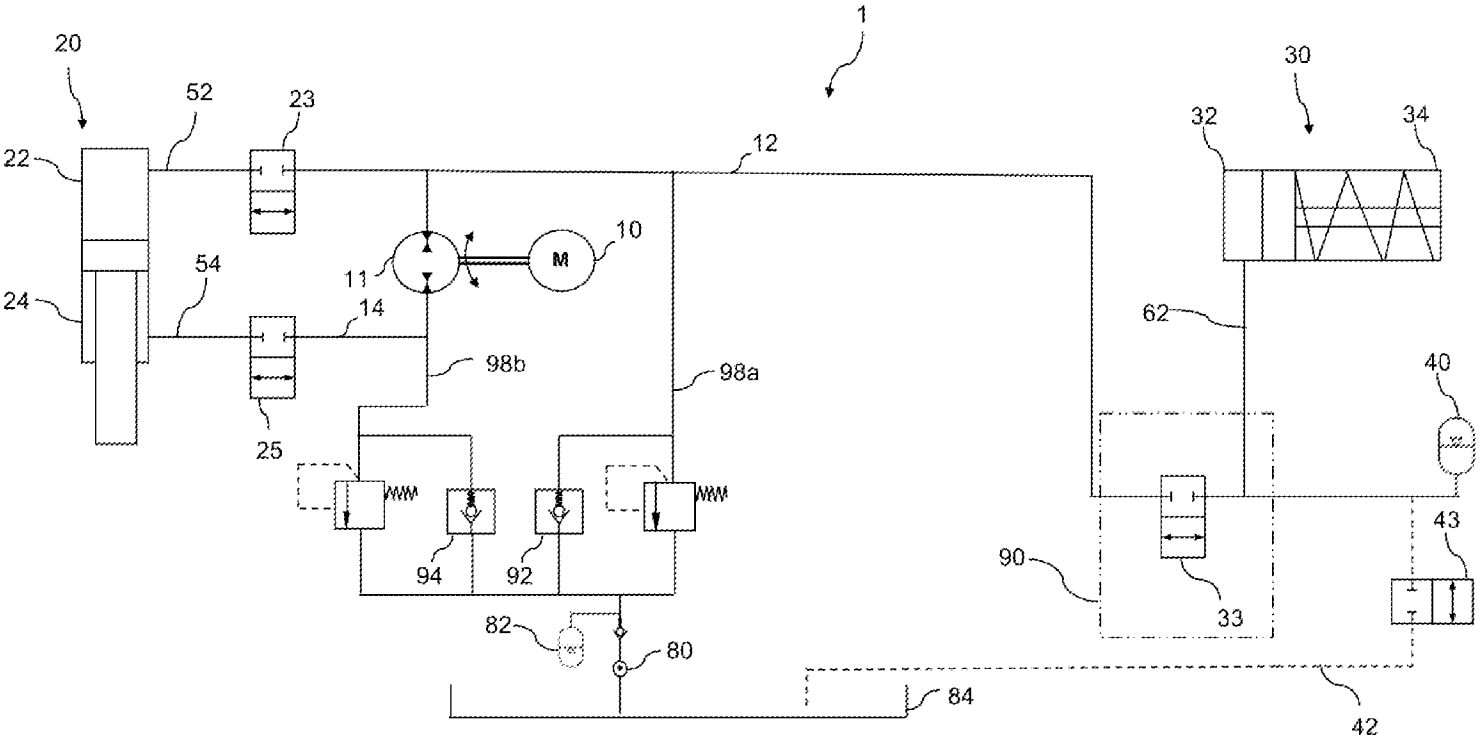
Figure 6:
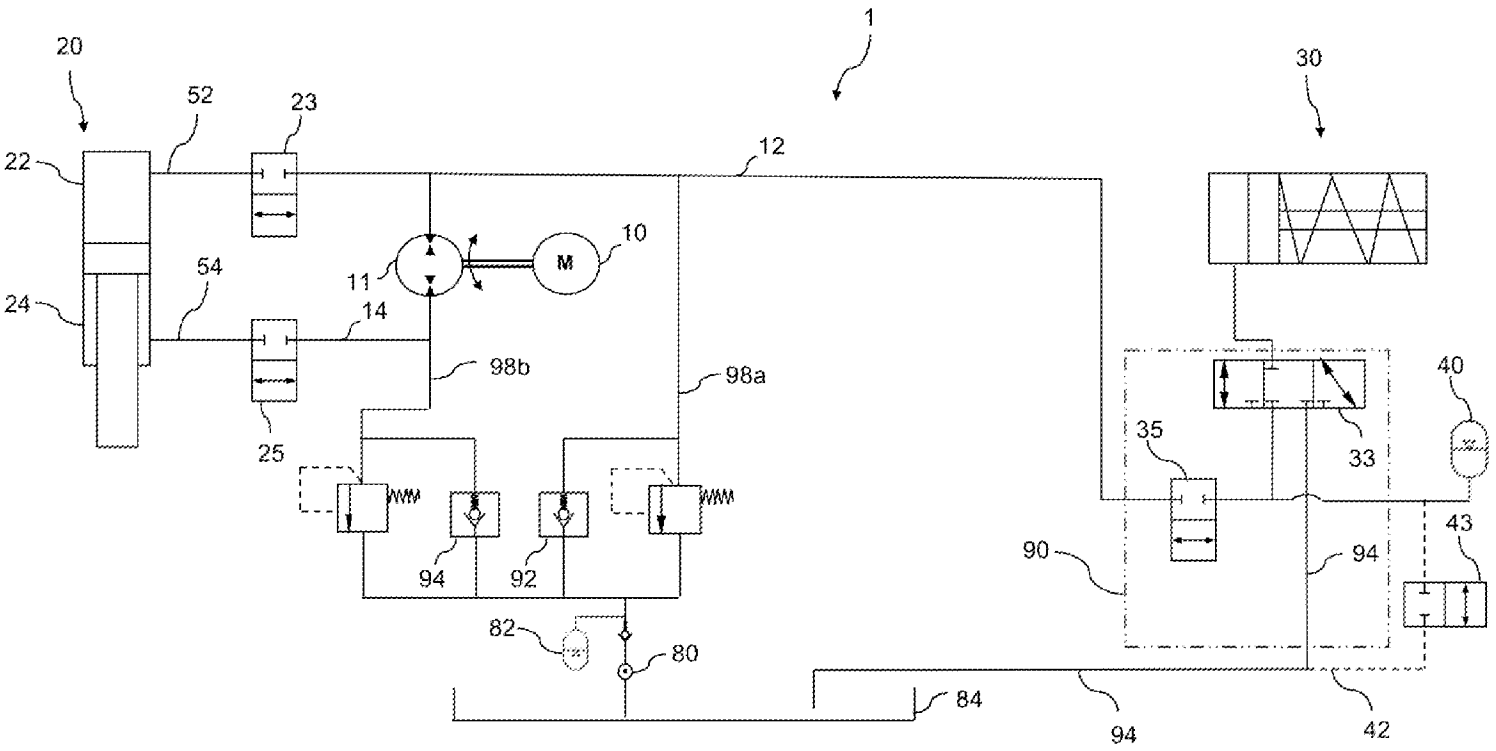

Shown are:

FIG. 1: a schematic general representation of a system according to the invention;

FIG. 2: a schematic representation of an exemplary embodiment of the system according to the invention according to FIG. 1;

FIG. 3: a schematic representation of an exemplary embodiment of the system according to the invention according to FIG. 2;

FIG. 4: a schematic representation of a further exemplary embodiment of the system according to the invention according to FIG. 1;

FIG. 5: a schematic representation of a further exemplary embodiment, wherein the secondary shaft is preloaded;

FIG. 6: a schematic representation of a further exemplary embodiment of the system according to the invention according to FIG. 5;

FIG. 1 shows a general arrangement of an exemplary embodiment of the actuator system 1 according to the invention with two movable shafts.

The exemplary embodiment of the actuator system 1 according to the invention has a volume-variable and/or rotational-speed-variable hydro machine 11, which is driven by an electric motor 10, for providing a volume flow of a hydraulic fluid.

The system 1 further comprises a main shaft 20 which is designed as a differential cylinder with a first chamber 22 and a second chamber 24, wherein the first chamber 22 is hydraulically connected by a first main hydraulic line 52 and by a first connection line 12, and the second chamber 24 is connected by a second main hydraulic line 54 and by a second connection line 14, to a connection of the hydro machine 11 in each case.

A first and a second main valve 23 and 25 are arranged between the hydro machine and the first and second chambers 22, 24 of the main shaft 20, respectively. These main valves are shown in FIG. 1 as a controlled 2/2-way valve with a flow and a shut position.

Furthermore, as can be seen in FIG. 1, the exemplary embodiment of the actuator system 1 according to the invention comprises a secondary shaft 30 which also has a first chamber 32 and a second chamber 34, wherein the first chamber 32 is hydraulically connected by a first secondary hydraulic line 62 and by the first connection line 12, and the second chamber 34 is connected by a second secondary hydraulic line 64 and by the second connection line 14, to a connection of the hydro machine 11 in each case.

In the present exemplary embodiment according to the invention, a valve assembly 90 and a hydraulic accumulator 40 are hydraulically connected to the secondary shaft 30. Some embodiments of how the valve assembly 90 is designed are illustrated in the next figures.

In general, the arrangement should be such that it is possible to operate both the main shaft 20 and the secondary shaft 30 sequentially and/or in parallel by means of a single hydro machine 11. It is, for example, important that, by means of the valve assembly 90, a hydraulic fluid flow from the first and/or second chambers 32, 34 of the secondary shaft 30 toward or from the hydro machine 11 can be shut off as desired so that the hydro machine 11 acts mainly on the main shaft 20. The valve assembly 90 should further be designed to allow the first and/or second chambers 32, 34 of the secondary shaft 30 to be relieved.

Furthermore, the system 1 has a source 80 and a preloading source 82, which serve to preload the connection lines 12 and 14 of the hydro machine 11. The hydro machine 11 is furthermore hydraulically connected to a tank 84 from which the hydro machine 11 extracts hydraulic fluid and feeds it into the system.

In this exemplary embodiment according to the invention, when one of the two first chambers 22 or 32 of the primary or secondary shaft 20, 30 is relieved, the hydraulic fluid flows into the preloading source 82 or the tank 84. This can be done, for example, by means of the hydro machine 11 and/or, as shown in FIG. 1, by an additional line 98*a* which is connected to the tank 84 or the preloading source 82 by a releasable valve 92, in this case a releasable non-return valve.

A further line 98*b* with a further releasable valve 94 serves both for hydraulically connecting the source 80 and the preloading source 82 to the hydro machine 11 and for relieving the second chamber 24, 34 of the main and/or secondary shaft 20, 30.

Alternatively or additionally, a drain line 42 may be hydraulically connected to the tank 84 and to a releasable valve 43 at the connection of the hydraulic accumulator. According to further exemplary embodiments according to the invention, the hydraulic accumulator 40 may be relieved by means of the additional line 42 and the releasable valve 43.

FIG. 2 shows an exemplary embodiment of the system according to the invention from FIG. 1. The general structure of the system 1 is unchanged.

The arrangement of the valves on the secondary shaft 30 is different. In particular, as can be seen in FIG. 2, the secondary shaft 30 is shown as a differential cylinder, wherein the arrangement of a synchronous cylinder is also conceivable. The secondary shaft 30 has a first chamber 32 and a hydraulic accumulator 40, which is connected to the first chamber 32 by the first secondary hydraulic line 62, and a second chamber 34.

The valve assembly 90 comprises a secondary valve 33, wherein the first chamber 32 and the second chamber 34 of the secondary shaft are hydraulically connected by the common secondary valve 33 to the hydro machine by the first secondary hydraulic line 62 or the second secondary hydraulic line 64.

In the exemplary embodiment according to the invention of FIG. 2, the first secondary valve 33 is a 4/2-way valve 33 having a flow position and a shut position so that both the first secondary hydraulic line 62 and the second secondary hydraulic lines 64 are either open at the same time or shut off simultaneously. In the first case, the hydro machine 11 can operate directly in the two chambers 32, 34 of the secondary shaft 30 and in the hydraulic accumulator 40. For example, the hydro machine 11 may provide a hydraulic fluid flow into the first chamber 32 of the secondary shaft 30 and into the hydraulic accumulator 40 so that the secondary shaft 30 is loaded as hydraulic fluid is withdrawn from the second chamber 34.

In the second case, that is to say when the secondary valve 33 is brought into the shut position, the hydraulic connection of the secondary shaft 30 to the hydro machine 11 is interrupted by the valve 33, wherein the secondary shaft 30 remains in a loaded state by the hydraulic accumulator 40. The hydro machine 11 can accordingly act in this case in the primary shaft 20 while the secondary shaft remains in a loaded state.

If relieving the first and/or second chambers of the secondary shaft 30 is intended, the secondary valve 33 can be adjusted to flow and the valves 92 and/or 94 are released so that hydraulic fluid can flow into the preloading source 82.

As in the exemplary embodiment of FIG. 1, the hydraulic accumulator 40 can be directly relieved into the tank 84 by means of a valve 43 and a drain line 42.

FIG. 3 shows a similar exemplary embodiment according to the invention of the actuator system as FIG. 2, wherein the valve assembly 90 comprises, instead of a single secondary valve, a first secondary valve 33 arranged in the first secondary hydraulic line 62 and a second secondary valve 35 arranged in the second secondary hydraulic line 64.

In this exemplary embodiment according to the invention, both the first and second secondary valves 33, 35 are controlled 2/2-way valves, each having a flow and a shut position. Thus, the loading and relieving of the first and/or second chambers 32, 34 of the secondary shaft can be controlled individually.

FIG. 4 shows an exemplary alternative embodiment of the system 1 according to the invention in accordance with one of the previous figures.

In this exemplary embodiment according to the invention of the actuator system 1, the valve assembly 90 comprises a 4/3-way valve 33 which has a flow, cross-flow and shut position and which is arranged in both the first secondary hydraulic line 62 and the second secondary hydraulic line 64, and a 2/2-way valve 35 which has a flow and shut position and which is arranged in a line connecting the hydraulic accumulator 40 and the secondary shaft 30 to the connection line 12.

In particular, a drain line 94 is connected to the 4/3-way valve 33 so that, in the respective flow positions, either the first chamber 32 or the second chamber 34 of the secondary shaft 30 is connected to the drain line 94. Furthermore, the drain line 94 is hydraulically connected to the tank 84 so that when the hydraulic fluid from one of the two chambers 32, 34 is relieved, it can flow directly into the tank 84.

The second secondary valve 35 blocks the connection of the secondary shaft 30 and the hydraulic accumulator 40 to the connection line 12 and accordingly to the rest of the system 1.

The hydraulic accumulator 40 can be relieved, for example, by means of the second secondary valve 35, through the line 12, 98*a* and by releasing the valve 92 or, as shown in the previous figures, through an alternative line 42.

As shown in FIG. 5, according to a further exemplary embodiment, the secondary shaft 30 may also be a preloaded cylinder instead of a differential cylinder.

The cylinder can be preloaded by means of a spring or also by means of a weight system, wherein the cylinder has at least one venting device in its preloaded chamber 34 so that the air can escape during the pressing process.

In this exemplary embodiment according to the invention, the valve assembly 90 comprises a 2-way valve 33 with a flow and a shut position; in this case, the first chamber 32 of the secondary shaft 30 is hydraulically connected to the connection line 12 and to the hydro machine 11 through the first hydraulic line 62 and the secondary valve 33, respectively.

Furthermore, the pressure accumulator 40 is also hydraulically connected both to the secondary hydraulic line 62 and to the secondary valve 33. For example, in order to relieve the first chamber 32 and the hydraulic accumulator 40, the secondary valve 33 and the controlled valve 92 may be released so that the relieved hydraulic fluid flows into the preloading source 82. Alternatively, in this exemplary embodiment according to the invention, the hydraulic accumulator 40 may also be hydraulically connected by a drain line 42 to a drain valve 43 in the tank 84. In this embodiment, however, it is only possible to relieve the first chamber 32 at the same time as the hydraulic accumulator 40.

In the exemplary embodiment according to the invention shown in FIG. 6 by contrast, the first chamber 32 of the secondary shaft 30 and the hydraulic accumulator 40 can each be relieved individually or together by means of the selected valve assembly 90.

In this case, the valve assembly 90 comprises a 3-way valve connected to the secondary hydraulic line, with a flow, a cross-flow and a shut position. Furthermore, the valve assembly comprises a second secondary valve 35 which, as in the previous example, is designed as a 2-way valve and connects the connection line 12 to the secondary shaft 30 and/or the hydraulic accumulator 40.

When the second secondary valve 35 is shut and the first secondary valve 33 is switched to the cross-flow position, a connection between the first chamber of the secondary shaft and the tank 84 is established by means of a line 94. In this case as well, the hydraulic accumulator 40 can be hydraulically connected to the tank 84 by a drain line 42 having a drain valve 43; thus, by shutting the first secondary valve 33 and opening the drain valve 43, just the relieving of the hydraulic accumulator 40 can be achieved.

| List of reference signs | |
|---|---|
| 1 | Actuator system |
| 10 | Electric motor |
| 11 | Hydro machine |
| 12 | First connection line |
| 14 | Second connection line |
| 20 | Main shaft |
| 22 | First chamber of the main shaft |
| 23 | First main valve |
| 24 | Second chamber of the main shaft |
| 25 | Second main valve |
| 30 | Secondary shaft |
| 32 | First chamber of the secondary shaft |
| 33 | First secondary valve |
| 34 | Second chamber of the secondary shaft |

-continued

| List of reference signs | |
|---|---|
| 35 | Second secondary valve |
| 40 | Hydraulic accumulator |
| 42 | Drain line |
| 43 | 2-way drain valve |
| 52 | First main hydraulic line |
| 54 | Second main hydraulic line |
| 62 | First secondary hydraulic line |
| 64 | Second secondary hydraulic line |
| 80 | Source |
| 82 | Preloading source |
| 84 | Tank |
| 90 | Valve assembly |
| 94 | Drain line |
| 98a, 98b | Drain lines |

The invention claimed is:

1. An electrohydrostatic actuator system having at least two movable shafts, comprising:

a volume-variable and/or rotational-speed-variable hydro machine, which is driven by an electric motor and comprises two connections, with two connection lines for providing a volume flow of a hydraulic fluid;

a main shaft which is movable by the hydraulic fluid and which has at least one first chamber, wherein the first chamber, with at least one first main hydraulic line and a first main valve, is hydraulically connected to a first connection of the hydro machine via a first connection line;

a secondary shaft which is movable by the hydraulic fluid and which has at least one first chamber, wherein the first chamber, with at least one first secondary hydraulic line and a first secondary valve, is hydraulically connected to the first connection of the hydro machine via the first connection line or to a second connection of the hydro machine via a second connection line;

a hydraulic accumulator hydraulically connected to the first secondary hydraulic line in an area between the first chamber of the secondary shaft and the first secondary valve; and the main shaft having at least one second chamber, wherein the second chamber, with at least one second main hydraulic line and a second main valve, is hydraulically connected to the second connection of the hydro machine via the second connection line.

2. The electrohydrostatic actuator system according to claim 1, wherein the hydraulic fluid is preloaded in the connection lines.

3. The electrohydrostatic actuator system according to claim 1, comprising another hydraulic accumulator hydraulically connected to the first main hydraulic line in an area between the first chamber of the main shaft and the first main valve.

4. The electrohydrostatic actuator system according to claim 1, wherein the first secondary hydraulic line and/or the first main hydraulic line are hydraulically connected to a drain line and a safety valve and/or a 2-way valve.

5. The electrohydrostatic actuator system according to claim 4, wherein the safety valve and/or the 2-way valve comprises a drain valve.

6. The electrohydrostatic actuator system according to claim 1, wherein the first chamber of the main shaft and the first chamber of the secondary shaft are hydraulically connected to the same connection line of the hydro machine.

7. The electrohydrostatic actuator system according to claim 1, wherein the first main valve and/or the first secondary valve are controlled valves.

8. The electrohydrostatic actuator system according to claim 1, wherein the main shaft and/or the secondary shaft is preloaded mechanically.

9. The electrohydrostatic actuator system according to claim 8, wherein the main shaft and/or the secondary shaft is preloaded mechanically with a spring system or a weight system.

10. The electrohydrostatic actuator system according to claim 1, wherein the secondary shaft has at least one second chamber, wherein the second chamber, with at least one second secondary hydraulic line and a second secondary valve, is hydraulically connected to the hydro machine via a connection line.

11. The electrohydrostatic actuator system according to claim 10, wherein the second chamber of the main shaft and the second chamber of the secondary shaft are hydraulically connected to the same connection line of the hydro machine, wherein the connection line is different from the connection line of the first chamber of the main shaft and the first chamber of the secondary shaft.

12. The electrohydrostatic actuator system according to claim 10, wherein the second main valve and/or the second secondary valve are controlled valves.

13. The electrohydrostatic actuator system according to claim 12, wherein at least one of the controlled valves can be released by means of a control valve.

14. The electrohydrostatic actuator system according to claim 13, wherein at least one of the control valves is hydraulically connected to at least one of the connection lines of the hydro machine by means of non-return valves.

15. The electrohydrostatic actuator system according to claim 1, wherein the main shaft is a reshaping shaft and the secondary shaft is a clamping shaft.

16. A method for operating the electrohydrostatic actuator system according to claim 1, wherein the main shaft and the secondary shaft are operated in parallel or sequentially by the same hydro machine.

17. The method for operating an electrohydrostatic actuator system according to claim 16, wherein the hydraulic fluid in the hydraulic accumulator is loaded when the secondary shaft is clamped.

18. The method for operating an electrohydrostatic actuator system according to claim 16, comprising the step of reshaping molded parts or deep-drawing molded parts.

* * * * *